United States Patent [19]

Cook

[11] 3,931,975

[45] Jan. 13, 1976

[54] GOLF CLUB

[76] Inventor: Raymon W. Cook, 406 Top Hill, San Antonio, Tex. 78209

[22] Filed: Aug. 12, 1974

[21] Appl. No.: 496,451

Related U.S. Application Data

[62] Division of Ser. No. 867,107, Sept. 10, 1969, Pat. No. 3,884,468.

[52] U.S. Cl. ..... 273/164; 273/78; 273/167 F

[51] Int. Cl.[2] ..... A63B 53/04

[58] Field of Search.... 273/77 R, 78, 164, 167–175, 273/183 R, 183 D, 194 R, 193 R; D34/5 GC, 5 GH

[56] References Cited

UNITED STATES PATENTS

| | | | |
|---|---|---|---|
| 1,046,343 | 12/1912 | Smith | 273/164 |
| 1,409,966 | 3/1922 | Plant | 273/164 |
| 1,854,548 | 4/1932 | Hunt | 273/78 |
| 2,007,377 | 7/1935 | Link | 273/167 F |
| 2,034,936 | 3/1936 | Barnhart | 273/78 |
| 2,174,212 | 9/1939 | Newsome | 273/164 |
| 2,254,528 | 9/1941 | Hoare | 273/167 F UX |
| 3,061,310 | 10/1962 | Giza | 273/78 |
| 3,408,074 | 10/1968 | Antonious | 273/169 X |
| D168,855 | 2/1953 | Paynor | 273/167 D X |
| D180,257 | 5/1957 | Wetzel | D34/5 GH |
| D196,734 | 10/1963 | Solheim | D34/5 GH |
| D202,715 | 11/1965 | Solheim | D34/5 GH |
| D203,512 | 1/1966 | Solheim | D34/5 GH |
| D207,228 | 3/1967 | Solheim | D34/5 GH |
| D211,103 | 5/1968 | Cook | 273/78 UX |
| R19,178 | 5/1934 | Spiker | 273/164 |

FOREIGN PATENTS OR APPLICATIONS

| | | | |
|---|---|---|---|
| 29,603 | 12/1913 | United Kingdom | 273/169 |

OTHER PUBLICATIONS

"Montgomery Ward Catalog"; 1939; p. 609.

"Golf World"; Apr. 30, 1965; p. 15.

*Primary Examiner*—Richard J. Apley

*Attorney, Agent, or Firm*—Cox, Smith, Smith, Hale & Guenther Incorporated

[57] ABSTRACT

A blade type golf club comprising an upstanding blade and a rearwardly extending flange, a longitudinally and horizontally extending groove of desired depth in the angle formed between said blade and said flange and extending forwardly into said blade, and an arcuately shaped groove of desired depth in the medial upper surface of said flange and intermeshed with said longitudinally and horizontally extending groove.

12 Claims, 12 Drawing Figures

GOLF CLUB

The subject application is a division of application Ser. No. 867,107, filed Sept. 10, 1969 and now U.S. Pat. No. 3,884,468.

The present invention relates to a golf club and more particularly to a putter wherein a portion of the golf club immediately behind the area of impact is removed whereby upon striking a golf ball vibrations are transferred from the golf club to the hands of the golfer and the golfer "feels" the stroke.

An object of the present invention is the provision of a golf club of novel construction which allows maximum transfer of vibrations from the club to the hands of the golfer thereby increasing the feel of the stroke.

Another object is the provision of a well-balanced golf club of novel construction.

A further object of the invention is the provision of a golf club the weight of which, prior to use, may be varied.

Yet another object is to provide a golf club which is simple in construction, inexpensive to manufacture, capable of mass production techniques, and adjustable, prior to use, by the manufacturer or the golf shop proprietor to fit the requirements of the individual golfer.

Other objects and features of the invention will become apparent to those skilled in the art as the disclosure is made in the following detailed description of preferred embodiments of the invention as illustrated in the accompanying sheets of drawing in which.

Figure 10:
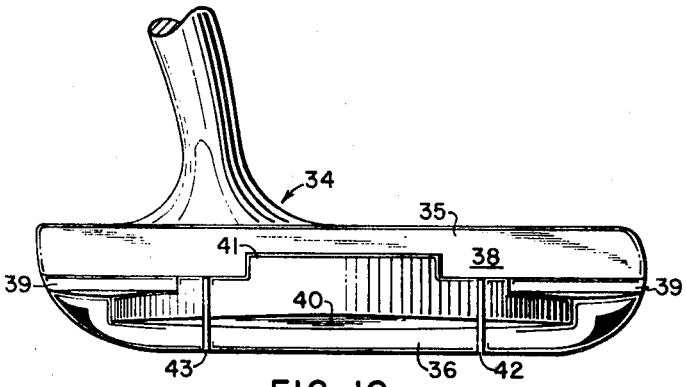
FIG. 10 is a fragmentary, rear elevational view of still another embodiment of the invention.
Figure 11:
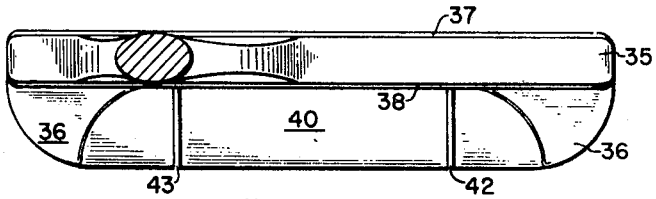
FIG. 11 is a fragmentary, top plan view of the embodiment of FIG. 10.
Figure 12:
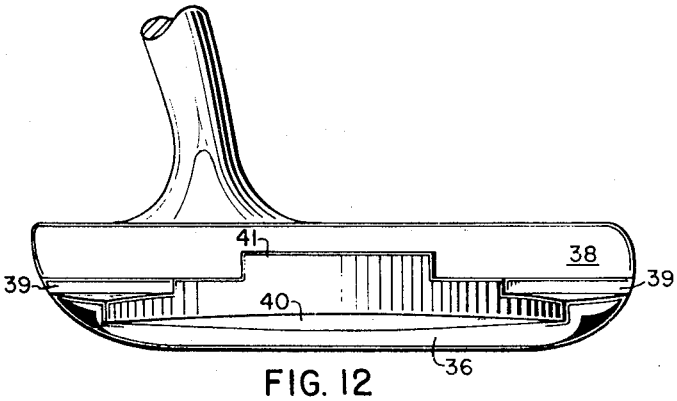
FIG. 12 is a fragmentary, rear elevational view of a modification of the embodiment of FIG. 10.

It is to be understood that although a full blade type putter is illustrated in FIGS. 1–6 of the drawings and a club including a centrally mounted shaft is illustrated in FIGS. 10–12, the subject invention is not restricted or limited to these two particular types of golf clubs only but the principles hereinafter to be described in detail are applicable to almost every currently available type of golf club head and especially to putters.

Referring now to the drawings, wherein like reference characters designate like or corresponding parts throughout the several views, there is shown in FIGS. 1–5, which illustrate a preferred embodiment of the invention, a full blade type putter 20 consisting, in part, of head 21 and shaft 22. The head 21 is provided with a slightly offset and generally upstanding hosel 23 which receives the lower end of shaft 22 in a manner such as is well-known in the art. Head 21 is constructed as a metal casting or forging and may be composed of brass, bronze, aluminum or similar composition. Shaft 22 is of conventional construction and may be provided at its upper end with gripping means, not shown, such as is well-known in the art.

Figure 4:
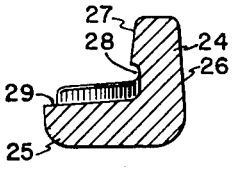
FIG. 4 is a vertical sectional view taken on the line 4—4 of FIG. 3, looking in the direction of the arrows.

As best seen in FIG. 4 of the drawings, head 21 further includes an upstanding blade 24 with flange 25 extending rearwardly from the lower end thereof. More particularly, blade 24 terminates forwardly in a substantially flat, generally upstanding face 26 which is elongated in a direction extending parallel to an imaginary plane containing the longitudinal axis of shaft 22 and also the longitudinal axis of the head. Face 26 is preferably inclined approximately 4° from the vertical to provide a loft or small pitch. In like manner, rear surface 27 of blade 24 is inclined approximately 4° from the vertical to maintain optical balance. A longitudinally and horizontally extending groove 28 is provided in the angle formed between blade 24 and flange 25, said groove ranges from one-sixteenth inch to three-sixteenths inch in height as measured from the upper surface of flange 25 and extends forwardly into said blade from one-eighth inch to one-fourth inch relative to the rear surface 27 whereby at least one-sixteenth inch but not exceeding five-sixteenths inch of material remains between the most forward limit of the said groove 28 and face 26.

Figure 1:
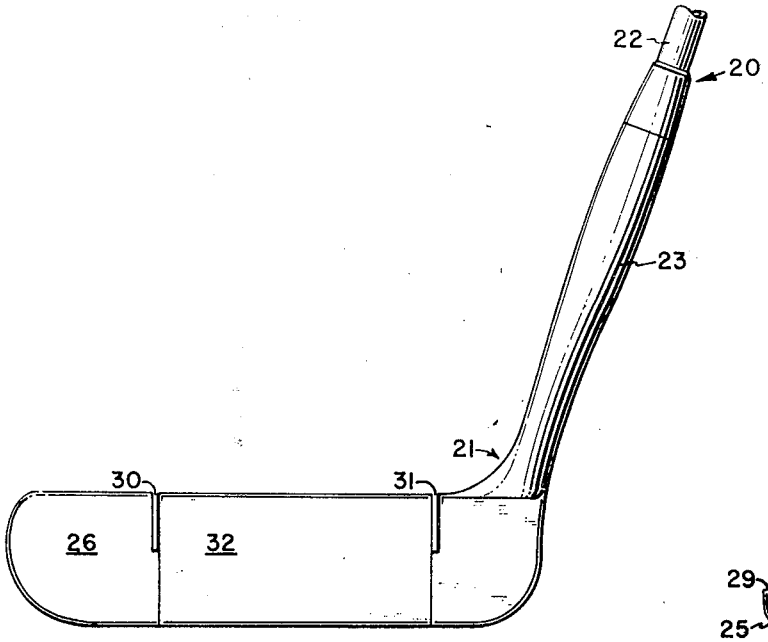
FIG. 1 is a fragmentary, front elevational view of the preferred embodiment of the invention.
Figure 2:
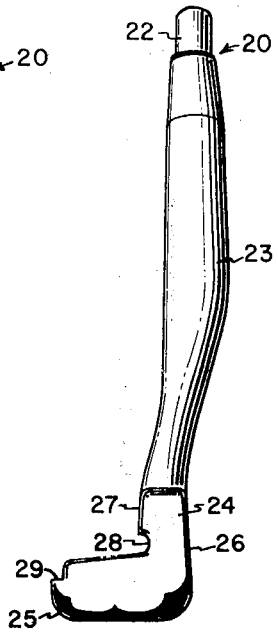
FIG. 2 is a fragmentary, end view of the embodiment of FIG. 1.
Figure 3:
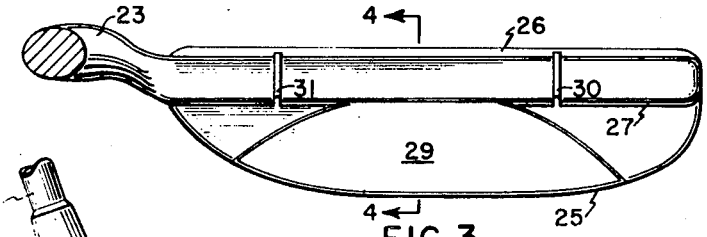
FIG. 3 is a fragmentary, top plan view of the embodiment of FIG. 1.
Figure 5:
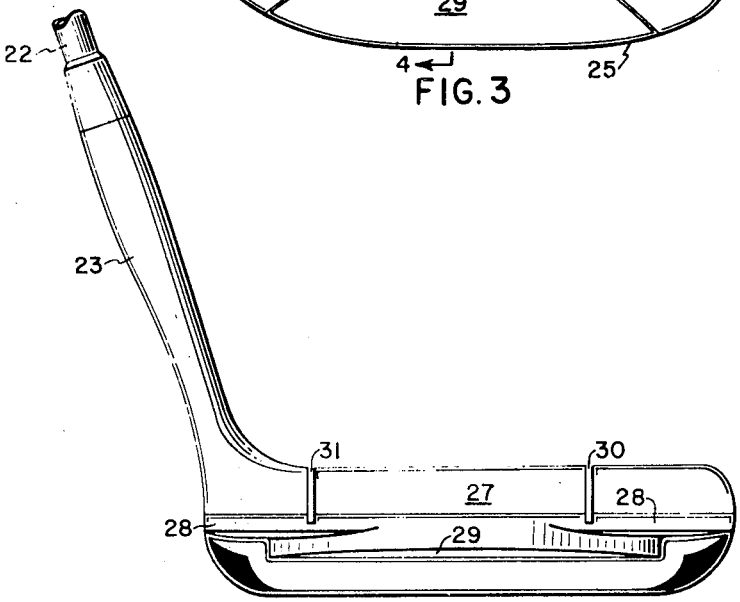
FIG. 5 is a fragmentary, rear elevational view of the embodiment of FIG. 1.
Figure 6:
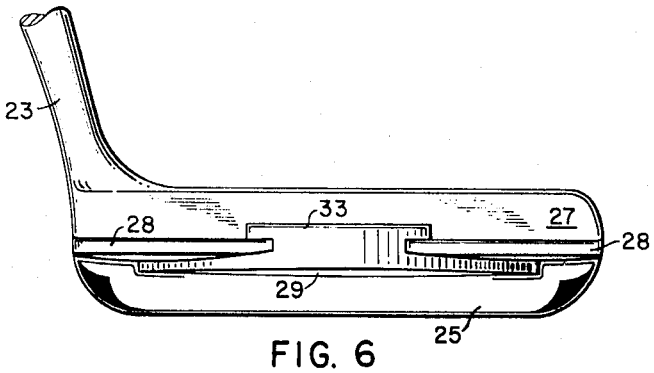
FIG. 6 is a fragmentary, rear elevational view of another embodiment of the invention.

Referring now to FIG. 3 of the drawings, the rear line of flange 25 is gradually curved at both heel and toe of said club head. An arcuately shaped flange groove 29 is centered relative to the club head and extends downwardly into the said flange 25 at least one-eighth inch but not exceeding one-fourth inch whereby at least one-sixteenth inch but not exceeding one-fourth inch of material remains between the floor of flange groove 29 and the sole of the golf club. As best seen in FIGS. 4 and 5, the medial portion of flange groove 29 intermeshes with and extends upwardly into groove 28; additionally, the floor of such flange groove 29 is inclined upwardly and forwardly at approximately 4° relative to the horizontal. The weight of the club head thus formed may be reduced by increasing the depth of flange groove 29 without affecting the weight at the heel and toe of the said club head, resulting in better dynamic balance.

Spaced and vertically extending alignment grooves 30–31 which are transverse to the longitudinal axis of the head are provided in blade 24, said alignment grooves are equally positioned on each side of the center of the club head; grooves 30, 31 are approximately two inches apart, extend downwardly into the blade from one-fourth to eleven-sixteenths inch whereby at least one-fourth inch but not exceeding eleven-sixteenths inch remains between the lower limit of said grooves and the sole of the golf club; preferably grooves 30, 31 terminate downwardly in horizontally extending groove 28. Alignment grooves 30, 31 not only define the center of balance of the club head but also said alignment grooves, in combination with groove 28, aid in transferring more vibrations and hence more feel to the hands of the golfer upon stroking a golf ball.

A rectangularly shaped portion 32 may be polished on face 26 between the alignment grooves; said polished portion may then be masked and the entire club head sand blasted, in a conventional manner, to produce an attractive and eye appealing club head.

It is to be understood that the invention is not to be restricted to require such alignment grooves. The embodiment of FIG. 6, for example, is constructed in accordance with the principles heretofore described in detail except for such alignment grooves. In such embodiment, an arcuately shaped recess 33 is provided in the medial, upper portion of the rear surface 27 of the blade, said recess extends upwardly from one-eighth to one-fourth inch relative to the floor of flange groove 29. Preferably the radius of curvature of recess 33 corresponds to that of flange groove 29; furthermore, the foremost vertical surface of recess 33 and flange groove 29 are coextensive; the foremost vertical surface of horizontal groove 28 is desirably coextensive with the foremost vertical surfaces of recess 33 and groove 29, respectively.

Figure 7:
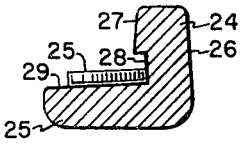
FIG. 7 is a vertical sectional view, transverse to the longitudinal axis of a modified club head, taken through the approximate center thereof.
Figure 8:
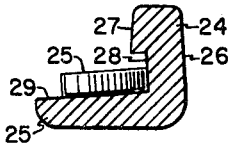
FIG. 8 is a vertical sectional view, transverse to the longitudinal axis of a modified club head, taken through the approximate center thereof.
Figure 9:
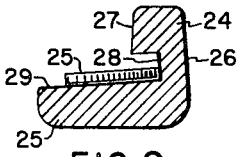
FIG. 9 is a vertical sectional view, transverse to the longitudinal axis of a modified club head, taken through the approximate center thereof.

As heretofore described, horizontal groove 28 and flange groove 29 may be varied both in depth and also the distance they extend into the blade. More particularly, as shown in FIG. 7, groove 28 which extends forwardly into blade 24 and flange groove 29 which extends downwardly into flange 25 are both at minimum depth; in such embodiment the corresponding foremost vertical surfaces of the said grooves are vertically aligned. As viewed in FIG. 8, groove 28 is at minimum depth in the said blade whereas flange groove 29 extends downwardly into flange 25 to maximum depth. In FIG. 9, on the other hand, groove 28 is at maximum depth in blade 24 whereby the minimum thickness of material remains between the foremost vertical surface of the said groove and the face of the club head; flange groove 29 is at minimum depth in flange 25 whereby approximately one-fourth inch of material remains between the floor of flange groove 29 and the sole of the club head. As heretofore mentioned, in those embodiments of the invention employing a recess 33, the corresponding foremost vertical surfaces of flange groove 29 and recess 33 are preferably in vertical alignment; however, flange groove 29 and recess 33 may be in vertical alignment and extend into blade 24 to a greater depth than groove 28, as viewed in FIG. 6 of the drawings.

As groove 28 approaches maximum depth in each of the embodiments of the invention heretofore described, the face of the club head is deadened; a golf ball stroked by such a club head will roll slower on a fast green. On the other hand, the weight of the club head is lessened as more material is removed from flange 25 and flange groove 29 is deepened.

There is shown in FIGS. 10-12 of the drawings a club head 34 having a shaft mounted between the ends of club head 34, commonly called a centrally mounted shaft; head 34 includes an upstanding blade 35 with flange 36 extending rearwardly from the lower end thereof. Blade 35 terminates forwardly in substantially flat, generally upstanding face 37 which is elongated in a direction extending parallel to an imaginary plane containng the longitudinal axis of the shaft and also the longitudinal axis of the head 34. Face 37 is preferably inclined from the vertical approximately 4° while rear surface 38 of the said blade is also inclined from the vertical by approximately 4° to maintain optical balance.

A longitudinally and horizontally extending groove 39 is conventionally provided in the angle formed between blade 35 and flange 36, respectively; said groove extends forwardly into the blade at least one-eighth but not exceeding one-fourth inch whereby at least one-sixteenth inch but not exceeding five-sixteenths inch of material remains between the foremost vertical surface thereof and face 37. As best seen in FIG. 11, the rear line of flange 36 is parallel to face 37 and is gradually curved at both heel and toe. Arcuately shaped flange groove 40 is preferably centered relative to the center of the face of the club head, said flange groove extends downwardly into the flange from one-eighth to one-fourth inch relative to the upper surface thereof. As shown in FIG. 10 of the drawings, the floor of such flange groove is slightly dished and inclined upwardly and forwardly at an angle of approximately 4° relative to the horizontal.

In the embodiments of FIGS. 10–12 an arcuately shaped recess 41 is provided in the medial, lower portion of the rear surface 38 of the blade, said recess extends upwardly from one-eighth to one-fourth inch relative to the floor of flange groove 40. Preferably the radius of curvature of recess 41 corresponds to that of flange groove 40 with the foremost vertical surface of recess 41 coextensive with the corresponding surface of flange groove 40. Furthermore, the foremost vertical surface of groove 39 may be coextensive with the corresponding surface of flange groove 40 and recess 41, or, as illustrated in FIGS. 10 and 12 of the drawings, the said flange groove 40 and recess 41 may extend into the blade 35 to a greater depth than groove 39.

Still referring to FIGS. 10 and 11 of the drawings, spaced and vertically extending alignment grooves 42–43 which are transverse to the longitudinal axis of the club head 34 are provided in flange 36 and extend upwardly into blade 35. The said alignment grooves are positioned laterally of the center of the said club head, are approximately 2 inches apart and extend upwardly at least one-half but not exceeding nine-sixteenths inch; preferably such alignment grooves terminate upwardly in groove 39.

It is to be understood that the centrally mounted club head 34 thus formed is not restricted to the use of such alignment grooves 42, 43 in combination with groove 39, flange groove 40 or recess 41. The embodiment of FIG. 12 is constructed in accordance with the principles heretofore described except for the use of such alignment grooves. Furthermore, the depth of groove 39, flange groove 40 and recess 41 may be varied in accordance with the principles heretofore described in detail.

It should be understood, of course, that the foregoing disclosure relates to only preferred embodiments of the invention and that numerous modifications or alterations may be made therein without departing from the spirit and scope of the invention as set forth in the appended claims.

What is claimed is:

1. In a golf club head consisting of an upstanding blade having a front face and a rear face with a flange extending rearwardly of the said blade, said flange having a top, a rear face and sole, a longitudinally and horizontally extending groove in the rear face of said blade extending completely across the rear face thereof, a flange groove extending downwardly into the top of said flange to an approximate uniform depth and terminating rearwardly substantially across the entire rear face of said flange, said flange groove communicating with said longitudinally and horizontally extending groove, first and second spaced and parallel alignment grooves in said flange groove, said alignment grooves being disposed transverse to the longitudinal axis of said club head and extending upwardly into said blade.

2. The invention of claim 1 wherein said first and second alignment grooves terminate downwardly of said longitudinally and horizontally extending groove.

3. The invention of claim 1 wherein said first and second alignment grooves terminate in said longitudinally and horizontally extending groove.

4. The invention of claim 1 wherein said first and second alignment grooves terminate above said longitudinally and horizontally extending groove.

5. The invention of claim 1 wherein said first and second alignment grooves extend upwardly into said blade ranging from one-half to nine-sixteenths inch.

6. In a golf club head consisting of an upstanding blade having a front face and a rear face and terminating downwardly in a rearwardly extending flange, said flange having a top, rear face and sole, a longitudinally and horizontally extending groove in the rear face of said blade and extending completely across the rear face thereof, an arcuate flange groove in said top of said flange and extending downwardly into said flange to an approximate uniform depth, said flange groove communicating with said longitudinally and horizontally extending groove, a recess in the rear face of said blade, said recess terminating downwardly in said longitudinally and horizontally extending groove, said recess and said flange groove extending forwardly into said blade, first and second spaced and parallel alignment grooves in said flange groove, said alignment grooves being disposed transverse to the longitudinal axis of said club head and extending upwardly into the front face of said blade.

7. The invention of claim 6 wherein said first and second alignment grooves terminate above said longitudinally and horizontally extending groove.

8. The invention of claim 6 wherein said first and second alignment grooves terminate in said longitudinally and horizontally extending groove.

9. The invention of claim 6 wherein said first and second alignment grooves terminate downwardly of said longitudinally and horizontally extending groove.

10. The invention of claim 6 wherein said first and second alignment grooves extend upwardly into said blade ranging from one-half to nine-sixteenths inch.

11. The invention of claim 6 wherein said recess and said flange groove extend forwardly into said blade and terminate forwardly of said longitudinally and horizontally extending groove.

12. The invention of claim 6 wherein said recess and said flange groove extend forwardly into said blade and terminate in the same approximate vertical plane.

* * * * *